US007495540B2

(12) United States Patent
Darr et al.

(10) Patent No.: US 7,495,540 B2
(45) Date of Patent: Feb. 24, 2009

(54) FUSIBLE SWITCHING DISCONNECT MODULES AND DEVICES

(75) Inventors: Matthew R. Darr, Godfrey, IL (US); Robert Stephen Douglass, Wildwood, MO (US); Matthew Thomas Dowil, Washington, MO (US)

(73) Assignee: Cooper Technologies Company, Houston, TX (US)

( * ) Notice: Subject to any disclaimer, the term of this patent is extended or adjusted under 35 U.S.C. 154(b) by 172 days.

(21) Appl. No.: 11/222,628

(22) Filed: Sep. 9, 2005

(65) Prior Publication Data

US 2006/0055498 A1 Mar. 16, 2006

Related U.S. Application Data

(60) Provisional application No. 60/609,431, filed on Sep. 13, 2004.

(51) Int. Cl.
*H01H 9/10* (2006.01)
*H01H 21/16* (2006.01)

(52) U.S. Cl. ..... 337/72; 337/8; 337/59; 337/62; 337/70; 337/61; 337/143

(58) Field of Classification Search ..... 337/143, 337/72, 8, 59, 62, 70, 61
See application file for complete search history.

(56) References Cited

U.S. PATENT DOCUMENTS 2,416,169 A * 2/1947 Freese ..... 337/44
3,032,629 A * 5/1962 Uecker ..... 335/23
3,614,697 A * 10/1971 Dunham et al. ..... 337/6
4,496,916 A 1/1985 Carpenter et al.
5,473,495 A * 12/1995 Bauer ..... 361/11
5,559,662 A * 9/1996 Happ et al. ..... 361/104
5,969,587 A * 10/1999 Combas ..... 335/132
6,717,505 B1 * 4/2004 Bruchmann ..... 337/194
6,727,797 B1 * 4/2004 Bruchmann ..... 337/210
6,864,443 B1 * 3/2005 Bruchmann ..... 200/50.01
7,115,829 B2 * 10/2006 Schmid ..... 200/400

FOREIGN PATENT DOCUMENTS

DE 101 48 863 A1 4/2003
EP 1 232 510 B1 8/2002
FR 2417839 A * 10/1979
GB 2 135 129 A 8/1984
WO WO 99/18589 4/1999
WO WO 01/39233 A1 * 5/2001

* cited by examiner

*Primary Examiner*—Anatoly Vortman
(74) *Attorney, Agent, or Firm*—Armstrong Teasdale LLP

(57) ABSTRACT

Fusible switch disconnect modules including a housing means adapted to receive at least one fuse therein, switchable contacts for connecting the fuse to circuitry and having at least one stationary contact and at least one movable contact selectively positionable between an open position and a closed position to connect or disconnect an electrical connection through the fuse, and a means for biasing or bias element assisting movement of the movable contact to the open or disconnected position.

27 Claims, 11 Drawing Sheets

FUSIBLE SWITCHING DISCONNECT MODULES AND DEVICES

CROSS REFERENCE TO RELATED APPLICATIONS

This application claims the benefit of U.S. Provisional Application Ser. No. 60/609,431 filed Sep. 13, 2004 and entitled Fusible Switching Disconnect Modules and Devices, the disclosure of which is hereby incorporated by reference in its entirety.

BACKGROUND OF THE INVENTION

This invention relates generally to fuses, and, more particularly, to fused disconnect switches.

Fuses are widely used as overcurrent protection devices to prevent costly damage to electrical circuits. Fuse terminals typically form an electrical connection between an electrical power source and an electrical component or a combination of components arranged in an electrical circuit. One or more fusible links or elements, or a fuse element assembly, is connected between the fuse terminals, so that when electrical current through the fuse exceeds a predetermined limit, the fusible elements melt and opens one or more circuits through the fuse to prevent electrical component damage.

In some applications, fuses are employed not only to provide fused electrical connections but also for connection and disconnection, or switching, purposes to complete or break an electrical connection or connections. As such, an electrical circuit is completed or broken through conductive portions of the fuse, thereby energizing or de-energizing the associated circuitry. Typically, the fuse is housed in a fuse holder having terminals that are electrically coupled to desired circuitry. When conductive portions of the fuse, such as fuse blades, terminals, or ferrules, are engaged to the fuse holder terminals, an electrical circuit is completed through the fuse, and when conductive portions of the fuse are disengaged from the fuse holder terminals, the electrical circuit through the fuse is broken. Therefore, by inserting and removing the fuse to and from the fuse holder terminals, a fused disconnect switch is realized.

DETAILED DESCRIPTION OF THE INVENTION

Known fused disconnects are subject to a number of problems in use. For example, any attempt to remove the fuse while the fuses are energized and under load may result in hazardous conditions because dangerous arcing may occur between the fuses and the fuse holder terminals. Some fuseholders designed to accommodate, for example, UL (Underwriters Laboratories) Class CC fuses and IEC (International Electrotechnical Commission) 10X38 fuses that are commonly used in industrial control devices include permanently mounted auxiliary contacts and associated rotary cams and switches to provide early-break and late-make voltage and current connections through the fuses when the fuses are pulled from fuse clips in a protective housing. One or more fuses may be pulled from the fuse clips, for example, by removing a drawer from the protective housing. Early-break and late-make connections are commonly employed, for example, in motor control applications. While early-break and late-make connections may increase the safety of such devices to users when installing and removing fuses, such features increase costs, complicate assembly of the fuseholder, and are undesirable for switching purposes.

Structurally, the early-break and late-make connections can be intricate and may not withstand repeated use for switching purposes. In addition, when opening and closing the drawer to disconnect or reconnect circuitry, the drawer may be inadvertently left in a partly opened or partly closed position. In either case, the fuses in the drawer may not be completely engaged to the fuse terminals, thereby compromising the electrical connection and rendering the fuseholder susceptible to unintended opening and closing of the circuit. Especially in environments subject to vibration, the fuses may be jarred loose from the clips. Still further, a partially opened drawer protruding from the fuseholder may interfere with workspace around the fuseholder. Workers may unintentionally bump into the opened drawers, and perhaps unintentionally close the drawer and re-energize the circuit.

Additionally, in certain systems, such as industrial control devices, electrical equipment has become standardized in size and shape, and because known fused disconnect switches tend to vary in size and shape from the standard norms, they are not necessarily compatible with power distribution panels utilized with such equipment. For at least the above reasons, use of fused disconnect switches have not completely met the needs of certain end applications.

Figure 1:
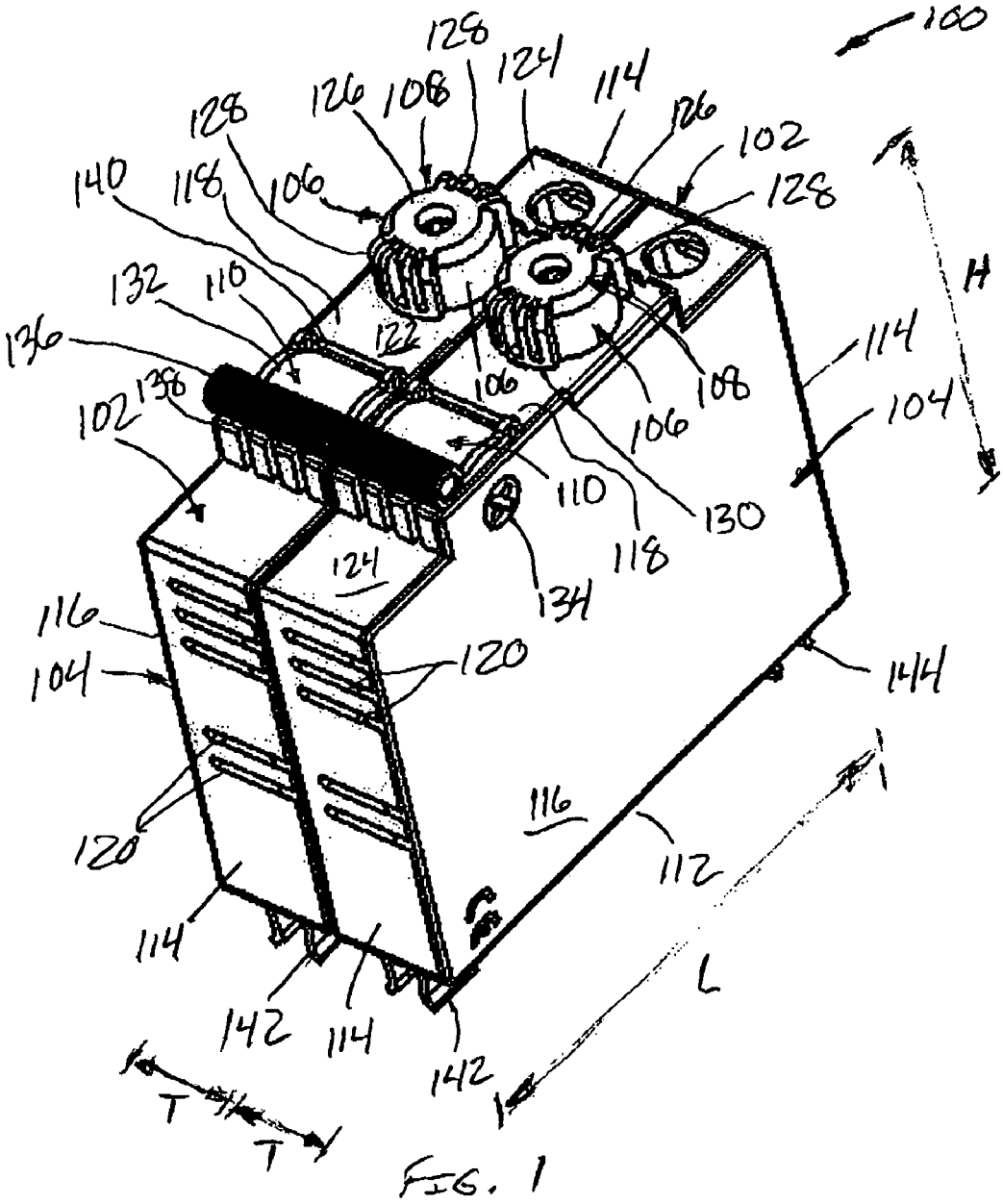
FIG. 1 is a perspective view of an exemplary fusible switching disconnect device.

FIG. 1 is a perspective view of an exemplary fusible switching disconnect device 100 that overcomes the aforementioned difficulties. The fusible switching disconnect device 100 may be conveniently switched on and off in a convenient and safe manner without interfering with workspace around the device 100. The disconnect device 100 may reliably switch a circuit on and off in a cost effective manner and may be used with standardized equipment in, for example, industrial control applications. Further, the disconnect device 100 may be provided with various mounting and connection options for versatility in the field. Various embodiments will be described below to demonstrate the versatility of the disconnect device, and it is contemplated that the disconnect device 100 may be beneficial in a variety of electrical circuits and applications. The embodiments set forth below are therefore provided for illustrative purposes only, and the invention is not intended to be limited to any specific embodiment or to any specific application.

In the illustrative embodiment of FIG. 1, the disconnect device 100 may be a two pole device formed from two separate disconnect modules 102. Each module 102 may include an insulative housing 104, a fuse 106 loaded into the housing 104, a fuse cover or cap 108 attaching the fuse to the housing 104, and a switch actuator 110. The modules 102 are single pole modules, and the modules 102 may be coupled or ganged together to form the two pole disconnect device 100. It is contemplated, however, that a multi-pole device could be formed in a single housing rather than in the modular fashion of the exemplary embodiment shown in FIG. 1.

The housing 104 may be fabricated from an insulative or nonconductive material, such as plastic, according to known methods and techniques, including but not limited to injection molding techniques. In an exemplary embodiment, the housing 104 is formed into a generally rectangular size and shape which is complementary to and compatible with DIN and IEC standards applicable to standardized electrical equipment. In particular, for example, each housing 104 has lower edge 112, opposite side edges 114, side panels 116 extending between the side edges 114, and an upper surface 118 extending between the side edges 114 and the side panels 116. The lower edge 112 has a length L and the side edges 114 have a thickness T, such as 17.5 mm in one embodiment, and the length L and thickness T define an area or footprint on the lower edge 112 of the housing 104. The footprint allows the lower edge 112 to be inserted into a standardized opening having a complementary shape and dimension. Additionally, the side edges 114 of the housing 104 have a height H in accordance with known standards, and the side edges 114 include slots 120 extending therethrough for ventilating the housing 104. The upper surface 118 of the housing 104 may be contoured to include a raised central portion 122 and recessed end portions 124 extending to the side edges 114 of the housing 104.

The fuse 106 of each module 102 may be loaded vertically in the housing 104 through an opening in the upper surface 118 of the housing 104, and the fuse 106 may extend partly through the raised central portion 122 of the upper surface 118. The fuse cover 108 extends over the exposed portion of the fuse 106 extending from the housing 104, and the cover 108 secures the fuse 106 to the housing 104 in each module 102. In an exemplary embodiment, the cover 108 may be fabricated from a non-conductive material, such as plastic, and may be formed with a generally flat or planar end section 126 and elongated fingers 128 extending between the upper surface 118 of the raised central portion 122 of the housing 104 and the end of the fuse 106. Openings are provided in between adjacent fingers 128 to ventilate the end of the fuse 106.

In an exemplary embodiment, the cover 108 further includes rim sections 130 joining the fingers 128 opposite the end section 126 of the cover 108, and the rim sections 130 secure the cover 108 to the housing 104. In an exemplary embodiment, the rim sections 130 cooperate with grooves in the housing 104 such that the cover 108 may rotate a predetermined amount, such as 25 degrees, between a locked position and a release position. That is, once the fuse 106 is inserted into the housing 104, the fuse cover 108 may be installed over the end of the fuse 106 into the groove of the housing 104, and the cover 108 may be rotated 25 degrees to the locked position wherein the cover 108 will frustrate removal of the fuse 106 from the housing 104. The groove may also be ramped or inclined such that the cover 108 applies a slight downward force on the fuse 106 as the cover 108 is installed. To remove the fuse 106, the cover 108 may be rotated from the locked position to the open position wherein both the cover 108 and the fuse 106 may be removed from the housing 104.

The switch actuator 110 may be located in an aperture 132 of the raised upper surface 122 of the housing 104, and the switch actuator 110 may partly extend through the raised upper surface 122 of the housing 104. The switch actuator 100 may be rotatably mounted to the housing 104 on a shaft or axle 134 within the housing 104, and the switch actuator 110 may include a lever, handle or bar 136 extending radially from the actuator 110. By moving the lever 136 from a first edge 138 to a second edge 140 of the aperture 132, the shaft 134 rotates to an open or switch position and electrically disconnects the fuse 106 in each module 102 as explained below. When the lever 136 is moved from the second edge 140 to the first edge 138, the shaft 134 rotates back to the closed position illustrated in FIG. 1 and electrically connects the fuse 106.

A line side terminal element may 142 extend from the lower edge 112 of the housing 104 in each module 102 for establishing line and load connections to circuitry. As shown in FIG. 1, the line side terminal element 142 is a bus bar clip configured or adapted to connect to a line input bus, although it is contemplated that other line side terminal elements could be employed in alternative embodiments. A panel mount clip 144 also extends from the lower edge 112 of the housing 104 to facilitate mounting of the disconnect device 100 on a panel.

Figure 2:
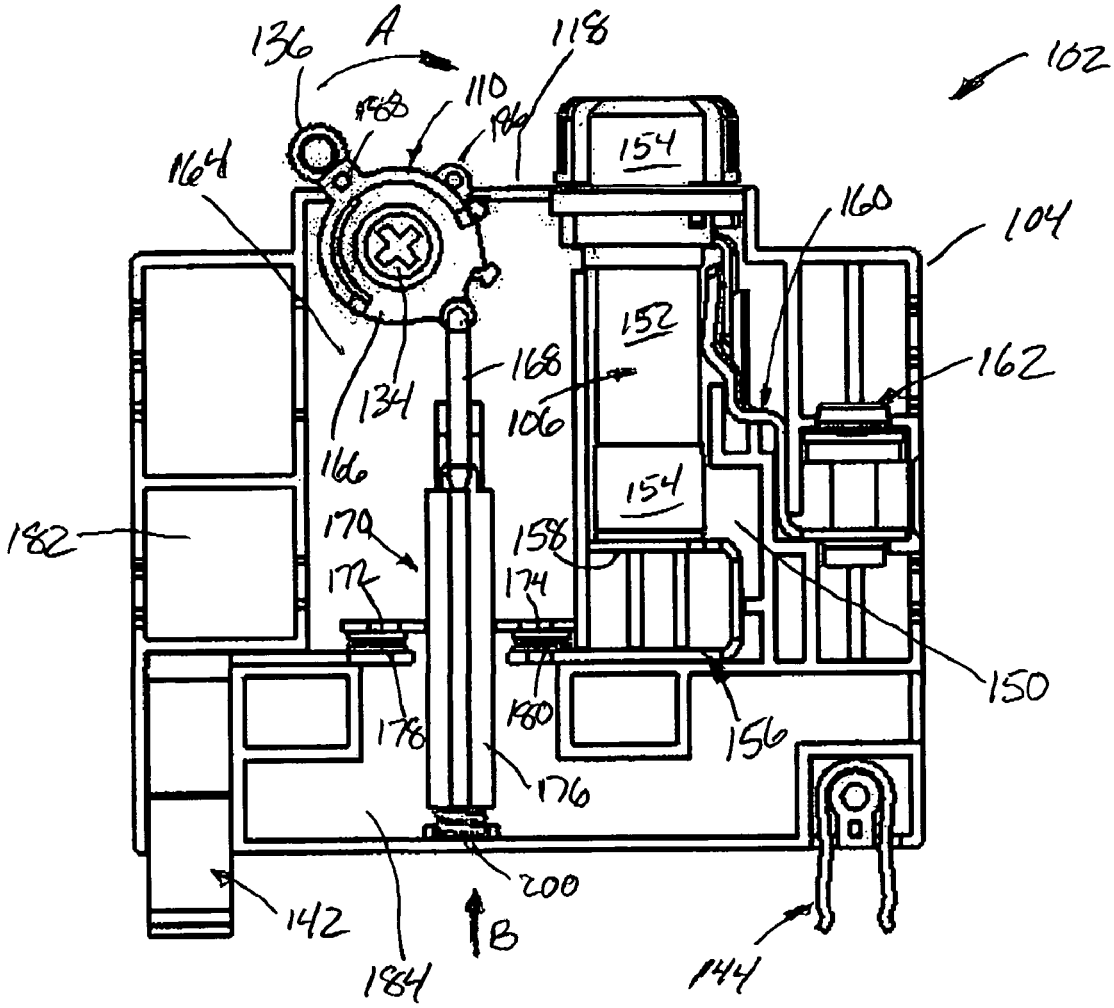
FIG. 2 is a side elevational view of a portion of the fusible switching disconnect device shown in FIG. 1 in a closed position.

FIG. 2 is a side elevational view of one of the disconnect modules 102 shown in FIG. 1 with the side panel 116 removed. The fuse 106 may be seen situated in a compartment 150 inside the housing 104. In an exemplary embodiment, the fuse 106 may be a cylindrical cartridge fuse including an insulative cylindrical body 152, conductive ferrules or end caps 154 coupled to each end of the body 152, and a fuse element or fuse element assembly extending within the body 152 and electrically connected to the end caps 154. In exemplary embodiments, the fuse 106 may be a UL Class CC fuse, a UL supplemental fuse, or an IEC 10X38 fuses which are commonly used in industrial control applications. These and other types of cartridge fuses suitable for use in the module 102 are commercially available from Cooper/Bussmann of St. Louis, Mo. It is understood that other types of fuses may also be used in the module 102 as desired.

A lower conductive fuse terminal 156 may be located in a bottom portion of the fuse compartment 150 and may be U-shaped in one embodiment. One of the end caps 154 of the fuse 106 rests upon an upper leg 158 of the lower terminal 156, and the other end cap 154 of the fuse 106 is coupled to an upper terminal 160 located in the housing 104 adjacent the fuse compartment 150. The upper terminal 160 is, in turn, connected to a load side terminal 162 to accept a load side connection to the disconnect module 102 in a known manner. The load side terminal 162 in one embodiment is a known saddle screw terminal, although it is appreciated that other types of terminals could be employed for load side connections to the module 102. Additionally, the lower fuse terminal 156 may include fuse rejection features in a further embodiment which prevent installation of incorrect fuse types into the module 102.

The switch actuator 110 may be located in an actuator compartment 164 within the housing 104 and may include the shaft 134, a rounded body 166 extending generally radially from the shaft 134, the lever 136 extending from the body 166, and an actuator link 168 coupled to the actuator body 166. The actuator link 168 may be connected to a spring loaded contact assembly 170 including first and second movable or switchable contacts 172 and 174 coupled to a sliding bar 176. In the closed position illustrated in FIG. 2, the switchable contacts 172 and 174 are mechanically and electrically engaged to stationary contacts 178 and 180 mounted in the housing 104. One of the stationary contacts 178 may be mounted to an end of the terminal element 142, and the other of the stationary contacts 180 may be mounted to an end of the lower fuse terminal 156. When the switchable contacts 172 and 174 are engaged to the stationary contacts 178 and 180, a circuit is path completed through the fuse 106 from the line terminal 142 and the lower fuse terminal 156 to the upper fuse terminal 160 and the load terminal 162.

While in an exemplary embodiment the stationary contact 178 is mounted to a terminal 142 having a bus bar clip, another terminal element, such as a known box lug or clamp terminal could be provided in a compartment 182 in the housing 104 in lieu of the bus bar clip. Thus, the module 102 may be used with a hard-wired connection to line-side circuitry instead of a line input bus. Thus, the module 102 is readily convertible to different mounting options in the field.

When the switch actuator 110 is rotated about the shaft 134 in the direction of arrow A, the siding bar 176 may be moved linearly upward in the direction of arrow B to disengage the switchable contacts 172 and 174 from the stationary contacts 178 and 180. The lower fuse terminal 156 is then disconnected from the line-side terminal element while the fuse 106 remains electrically connected to the lower fuse terminal 156 and to the load side terminal 162. An arc chute compartment 184 may be formed in the housing 104 beneath the switchable contacts 172 and 174, and the arc chute may provide a space to contain and dissipate arcing energy as the switchable contacts 172 and 174 are disconnected. Arcing is broken at two locations at each of the contacts 172 and 174, thus reducing arc intensity, and arcing is contained within the lower portions of the housing 104 and away from the upper surface 118 and the hands of a user when manipulating the switch actuator 110 to disconnect the fuse 106 from the line side terminal 142.

Figure 3:
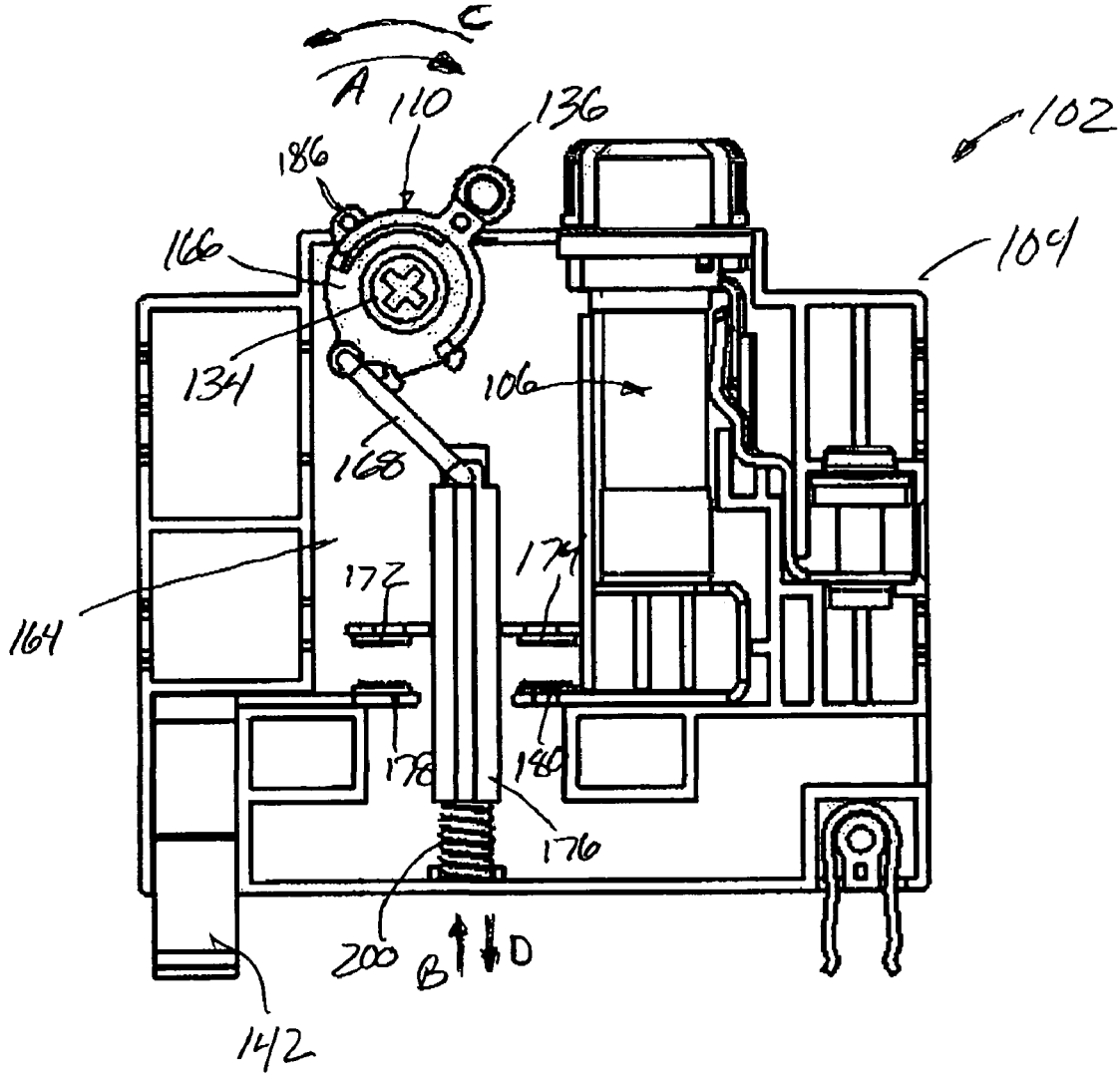
FIG. 3 is a side elevational view of a portion of the fusible switching disconnect device shown in FIG. 1 in an open position.

The housing 104 additionally may include a locking ring 186 which may be used cooperatively with a retention aperture 188 in the switch actuator body 166 to secure the switch actuator 110 in one of the closed position shown in FIG. 2 and the open position shown in FIG. 3. A locking pin for example, may be inserted through the locking ring 186 and the retention aperture 188 to restrain the switch actuator in the corresponding open or closed position. Additionally, a fuse retaining arm could be provided in the switch actuator 110 to prevent removal of the fuses except when the switch actuator 110 is in the open position.

FIG. 3 illustrates the disconnect module 102 after the switch actuator has been moved in the direction of Arrow A to an open or switched position to disconnect the switchable contacts 172 and 174 from the stationary contacts 178 and 180. As the actuator is moved to the open position, the actuator body 166 rotates about the shaft 134 and the actuator link 168 is accordingly moved upward in the actuator compartment 164. As the link 168 moves upward, the link 168 pulls the sliding bar 176 upward in the direction of arrow B to separate the switchable contacts 172 and 174 from the stationary contacts 178 and 180.

A bias element 200 may be provided beneath the sliding bar 176 and may force the sliding bar 176 upward in the direction of arrow B to a fully opened position separating the contacts 172, 174 and 178, 180 from one another. Thus, as the actuator body 166 is rotated in the direction of arrow A, the link 168 is moved past a point of equilibrium and the bias element 200 assists in opening of the contacts 172, 174 and 178, 180. The bias element 200 therefore prevents partial opening of the contacts 172, 174 and 178, 180 and ensures a full separation of the contacts to securely break the circuit through the module 102.

Additionally, when the actuator lever 136 is pulled back in the direction of arrow C to the closed position shown in FIG. 2, the actuator link 168 is moved to position the sliding bar 176 downward in the direction of arrow D to engage and close the contacts 172, 174 and 178, 180 and reconnect the circuit through the fuse 106. The sliding bar 176 is moved downward against the bias of the bias element 200, and once in the closed position, the sliding bar 176, the actuator link 168 and the switch actuator are in static equilibrium so that the switch actuator 110 will remain in the closed position.

In one exemplary embodiment, and as illustrated in FIGS. 2 and 3, the bias element 200 may be a helical spring element which is loaded in compression in the closed position of the switch actuator 110. It is appreciated, however, that in an alternatively embodiment a coil spring could be loaded in tension when the switch actuator 110 is closed. Additionally, other known bias elements could be provided to produce opening and/or closing forces to assist in proper operation of the disconnect module 102. Bias elements may also be utilized for dampening purposes when the contacts are opened.

The lever 136, when moved between the opened and closed positions of the switch actuator, does not interfere with workspace around the disconnect module 102, and the lever 136 is unlikely to be inadvertently returned to the closed position from the open position. In the closed position shown in FIG. 3, the lever 136 is located adjacent to an end of the fuse 106. The fuse 106 therefore partly shelters the lever 136 from inadvertent contact and unintentional actuation to the closed position. The bias element 200 further provides some resistance to movement of the lever 136 and closing of the contact mechanism. Additionally, the stationary contacts 178 and 180 are at all times protected by the housing 104 of the module 102, and any risk of electrical shock due to contact with line side terminal 142 and the stationary contacts 178 and 180 is avoided. The disconnect module 102 is therefore considered to be safer than many known fused disconnect devices.

When the modules 102 are ganged together to form a multi-pole device, such as the device 100, one lever 136 may be extended through and connect to multiple switch actuators 110 for different modules. Thus, all the connected modules 102 may be disconnected and reconnected by manipulating a single lever 136. That is, multiple poles in the device 100 may be switched simultaneously. Alternatively, the switch actuators 110 of each module 102 in the device 100 may be actuated independently with separate levers 136 for each module.

Figure 4:
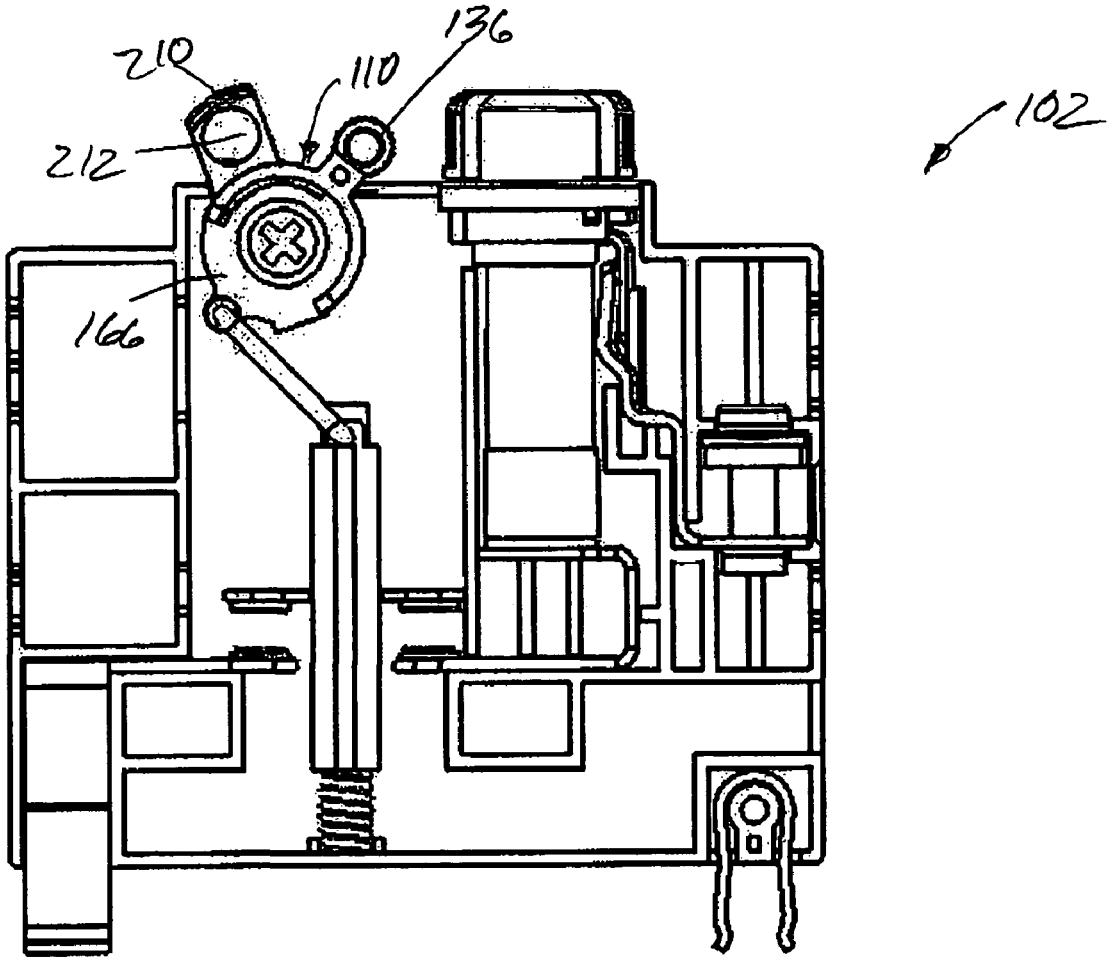
FIG. 4 is a side elevational view of a second embodiment of a fusible switching disconnect device.

FIG. 4 is a side elevational view of a further exemplary embodiment of a fusible switching disconnect 102 including, for example, a retractable lockout tab 210 which may extend from the switch actuator 110 when the lever 136 is moved to the open position. The lockout tab 210 may be provided with a lock opening 212 therethrough, and a padlock or other element may be inserted through the lock opening 212 to ensure that the lever 136 may not be moved to the closed position. In different embodiments, the lockout tab 210 may be spring loaded and extended automatically, or may be manually extended from the switch actuator body 166. When the lever 136 is moved to closed position, the lockout tab 210 may be automatically or manually returned to retracted position wherein the switch actuator 110 may be rotated back to the closed position shown in FIG. 2.

Figure 5:
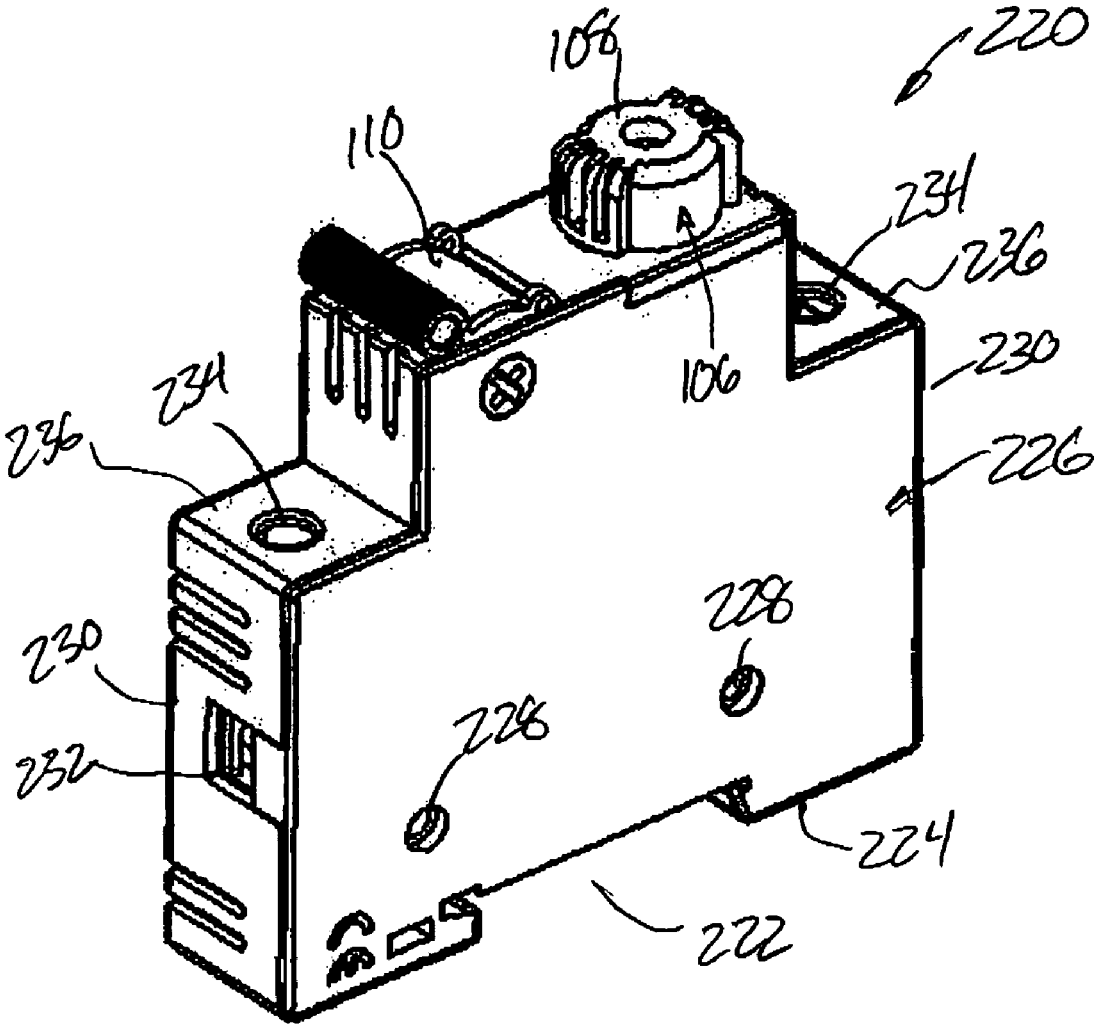
FIG. 5 is a perspective view of a third embodiment of a fusible switching disconnect device.

FIG. 5 is a perspective view of a third exemplary embodiment of a fusible switching disconnect module 220 similar to the module 102 described above but having, for example, a DIN rail mounting slot 222 formed in a lower edge 224 of a housing 226. The housing 226 may also include openings 228 which may be used to gang the module 220 to other disconnect modules. Side edges 230 of the housing 226 may include connection openings 232 for line side and load connections to box lugs or clamps within the housing 226. Access openings 234 may be provided in recessed upper surfaces 236 of the housing 226. A stripped wire, for example, may be extended through the connection openings 232 and a screwdriver may be inserted through the access openings 234 to connect line and load circuitry to the module 220.

Like the module 102, the module 220 may include the fuse 106, the fuse cover 108 and the switch actuator 110. Switching of the module is accomplished with switchable contacts as described above in relation to the module 102.

Figure 6:
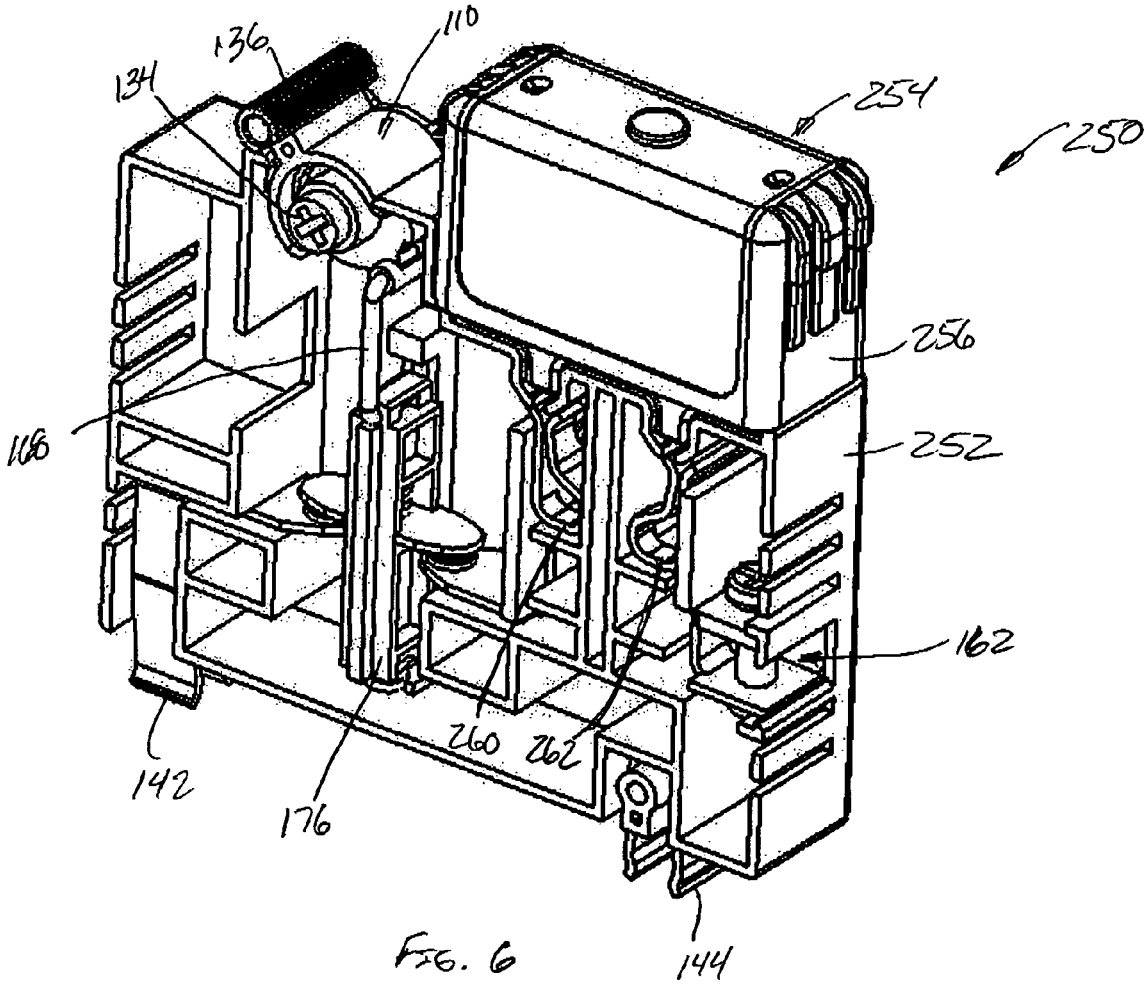
FIG. 6 is a perspective view of a fourth embodiment of a fusible switching disconnect device.
Figure 7:
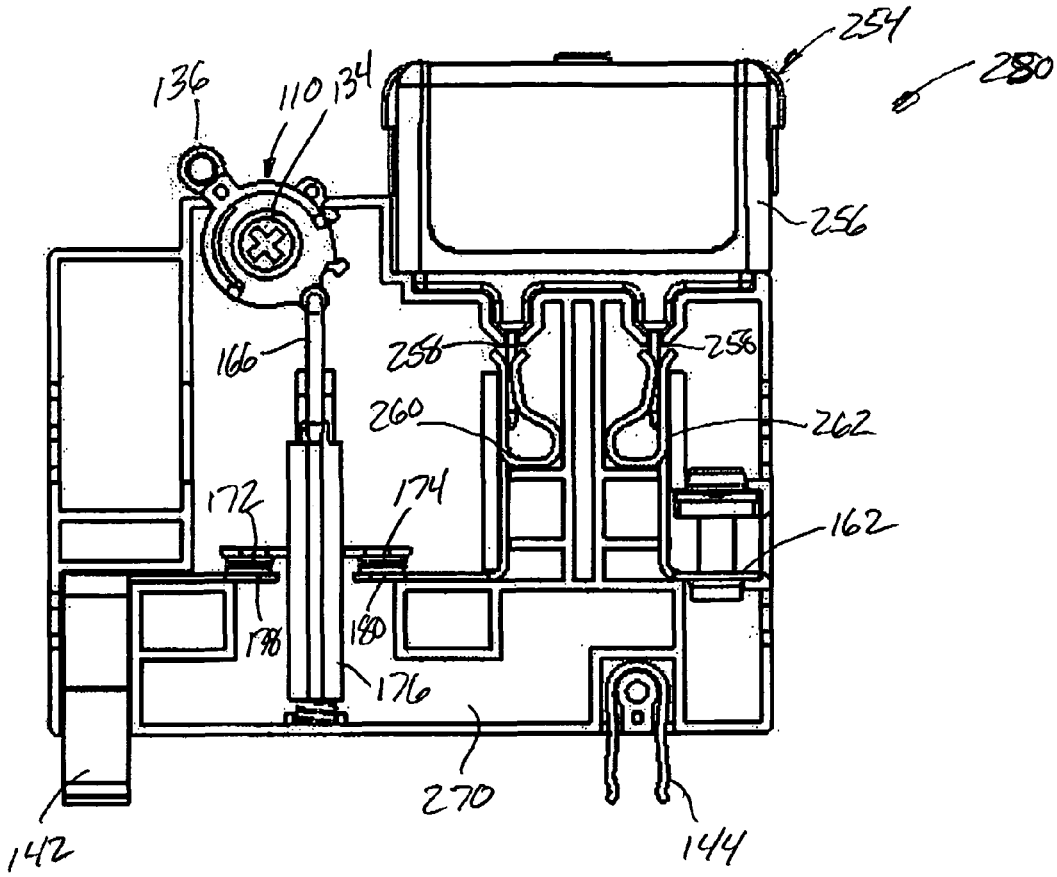
FIG. 7 is a side elevational view of the fusible switching disconnect device shown in FIG. 7.

FIGS. 6 and 7 are perspective views of a fourth exemplary embodiment of a fusible switching disconnect module 250 which, like the modules 102 and 220 described above, includes a switch actuator 110 rotatably mounted to the housing on a shaft 134, a lever 136 extending from the actuator link 168 and a slider bar 176. The module 250 also includes, for example, a mounting clip 144 and a line side terminal element 142.

Unlike the modules 102 and 220, the module 250 may include a housing 252 configured or adapted to receive a rectangular fuse module 254 instead of a cartridge fuse 106. The fuse module 254 is a known assembly including a rectangular housing 256, and terminal blades 258 extending from the housing 256. A fuse element or fuse assembly may be located within the housing 256 and is electrically connected between the terminal blades 258. Such fuse modules 254 are known and in one embodiment are CubeFuse modules commercially available from Cooper/Bussmann of St. Louis, Mo.

A line side fuse clip 260 may be situated within the housing 252 and may receive one of the terminal blades 258 of the fuse module 254. A load side fuse clip 262 may also be situated within the housing 252 and may receive the other of the fuse terminal blades 258. The line side fuse clip 260 may be electrically connected to the stationary contact 180. The load side fuse clip 262 may be electrically connected to the load side terminal 162. The line side terminal 142 may include the stationary contact 178, and switching may be accomplished by rotating the switch actuator 110 to engage and disengage the switchable contacts 172 and 174 with the respective stationary contacts 178 and 180 as described above. While the line terminal 142 is illustrated as a bus bar clip, it is recognized that other line terminals may be utilized in other embodiments, and the load side terminal 162 may likewise be another type of terminal in lieu of the illustrated saddle screw terminal in another embodiment.

The fuse module 254 may be plugged into the fuse clips 260, 262 or extracted therefrom to install or remove the fuse module 254 from the housing 252. For switching purposes, however, the circuit is connected and disconnected at the contacts 172, 174 and 178 and 180 rather than at the fuse clips 260 and 262. Arcing between the disconnected contacts may therefore contained in an arc chute or compartment 270 at the lower portion of the compartment and away from the fuse clips 260 and 262. By opening the disconnect module 250 with the switch actuator 110 before installing or removing the fuse module 254, any risk posed by electrical arcing or energized metal at the fuse and housing interface is eliminated. The disconnect module 250 is therefore believed to be safer to use than many known fused disconnect switches.

A plurality of modules 250 may be ganged or otherwise connected together to form a multi-pole device. The poles of the device could be actuated with a single lever 136 or independently operable with different levers.

Figure 8:
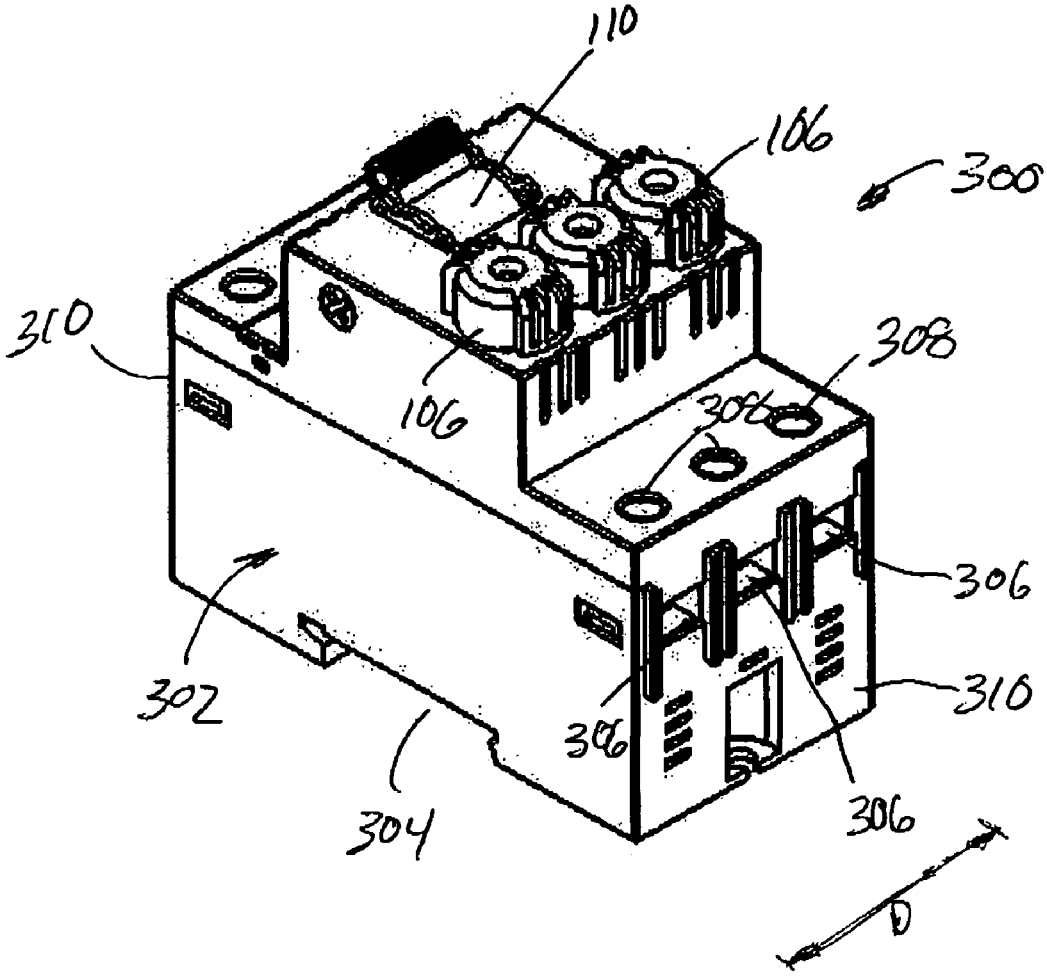
FIG. 8 is a perspective view of a fifth embodiment of a fusible switching disconnect device.

FIG. 8 is a perspective view of a fifth exemplary embodiment of a fusible switching disconnect device 300 which is, for example, a multi-pole device in an integrated housing 302. The housing 302 may be constructed to accommodate three fuses 106 in an exemplary embodiment, and is therefore well suited for a three phase power application. The housing 204 may include a DIN rail slot 304 in the illustrated embodiment, although it is understood that other mounting options, mechanisms, and mounting schemes may be utilized in alternative embodiments. Additionally, in one embodiment the housing 204 may have a width dimension D of about 45 mm in accordance with IEC industry standards for contactors, relays, manual motor protectors, and integral starters that are also commonly used in industrial control systems applications. The benefits of the invention, however, accrue equally to devices having different dimensions and devices for different applications.

The housing may also include connection openings 306 and access openings 308 in each side edge 310 which may receive a wire connection and a tool, respectively, to establish line and load connections to the fuses 106. A single switch actuator 110 may be rotated to connect and disconnect the circuit through the fuses between line and load terminals of the disconnect device 300.

Figure 9:
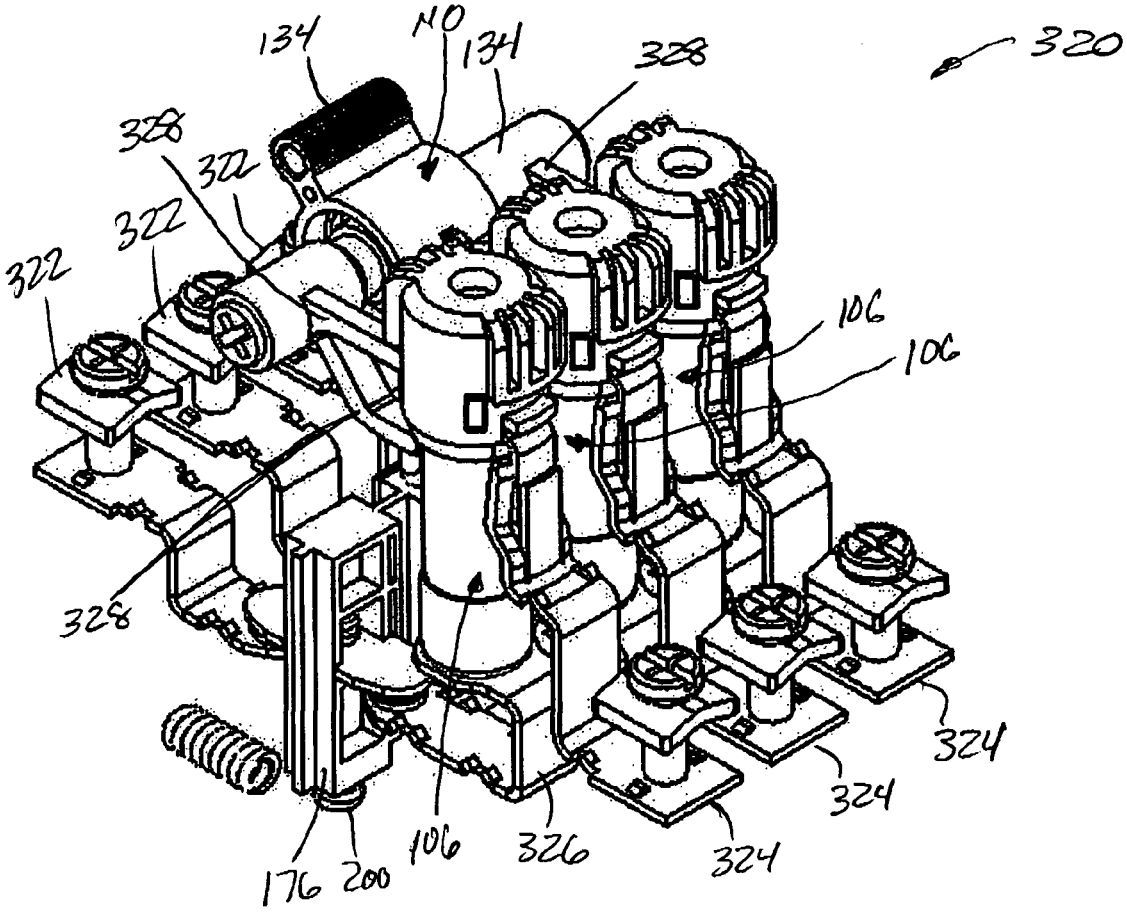
FIG. 9 is a perspective view of a portion of the fusible switching disconnect device shown in FIG. 8.

FIG. 9 is a perspective view of an exemplary switching assembly 320 for the device 300. The switching assembly may be accommodated in the housing 302 and in an exemplary embodiment may include a set of line terminals 322, a set of load terminals 324, a set of lower fuse terminals 326 associated with each respective fuse 106, and a set of slider bars 176 having switchable contacts mounted thereon for engaging and disengaging stationary contacts mounted to the ends of the line terminals 322 and the lower fuse terminals 324. An actuator link (not visible in FIG. 9) may be mounted to an actuator shaft 134, such that when the lever 136 is rotated, the slider bar 176 may be moved to disconnect the switchable contacts from the stationary contacts. Bias elements 200 may be provided beneath each of the slider bars 176 and assist operation of the switch actuator 110 as described above. As with the foregoing embodiments of modules, a variety of line side and load side terminal structures may be used in various embodiments of the switching assembly.

Retention bars 328 may also be provided on the shaft 134 which extend to the fuses 106 and engage the fuses in an interlocking manner to prevent the fuses 106 from being removed from the device 300 except when the switch actuator 110 is in the open position. In the open position, the retention bars 328 may be angled away from the fuses 106 and the fuses may be freely removed. In the closed position, as shown in FIG. 9, the retention arms or bars 328 lock the fuse in place. In an exemplary embodiment, distal ends of the bars or arms 328 may be received in slots or detents in the fuses 106, although the fuses 106 could be locked in another manner as desired.

Figure 10:
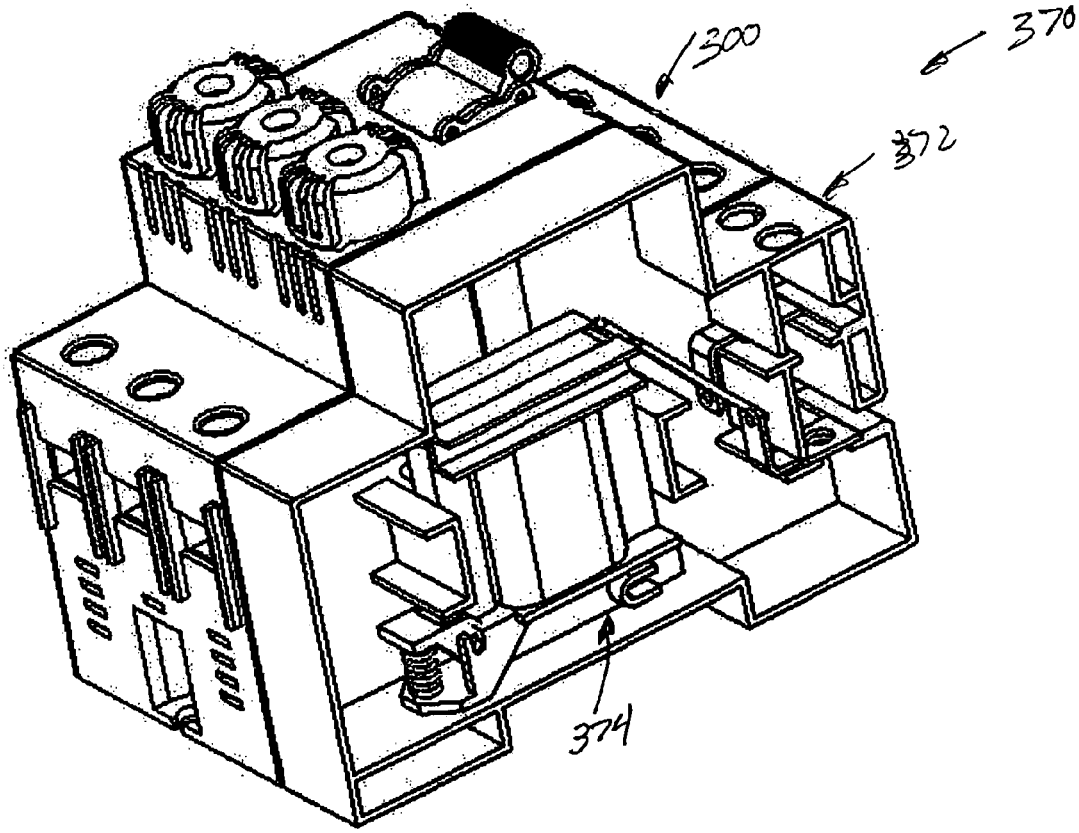
FIG. 10 is a perspective view of a sixth embodiment of a fusible switching disconnect device.

FIG. 10 is a perspective view of a sixth exemplary embodiment of a fusible switching disconnect device 370 including the disconnect module 300 described above and, for example, an under voltage module 372 mounted to one side of the module 300 and mechanically linked to the switch mechanism in the module 300. In an exemplary embodiment, the under voltage module 372 may include an electromagnetic coil 374 calibrated to a predetermined voltage range. When the voltage drops below the range, the electromagnetic coil causes the switch contacts in the module 300 to open. A similar module 372 could be employed in an alternative embodiment to open the switch contacts when the voltage experienced by the electromagnetic exceeds a predetermined voltage range, and may therefore serve as an overvoltage module. In such a manner, the switch contact in the module 300 could be opened with module 372 and the coil 374 as undervoltage or overvoltage conditions occur.

Figure 11:
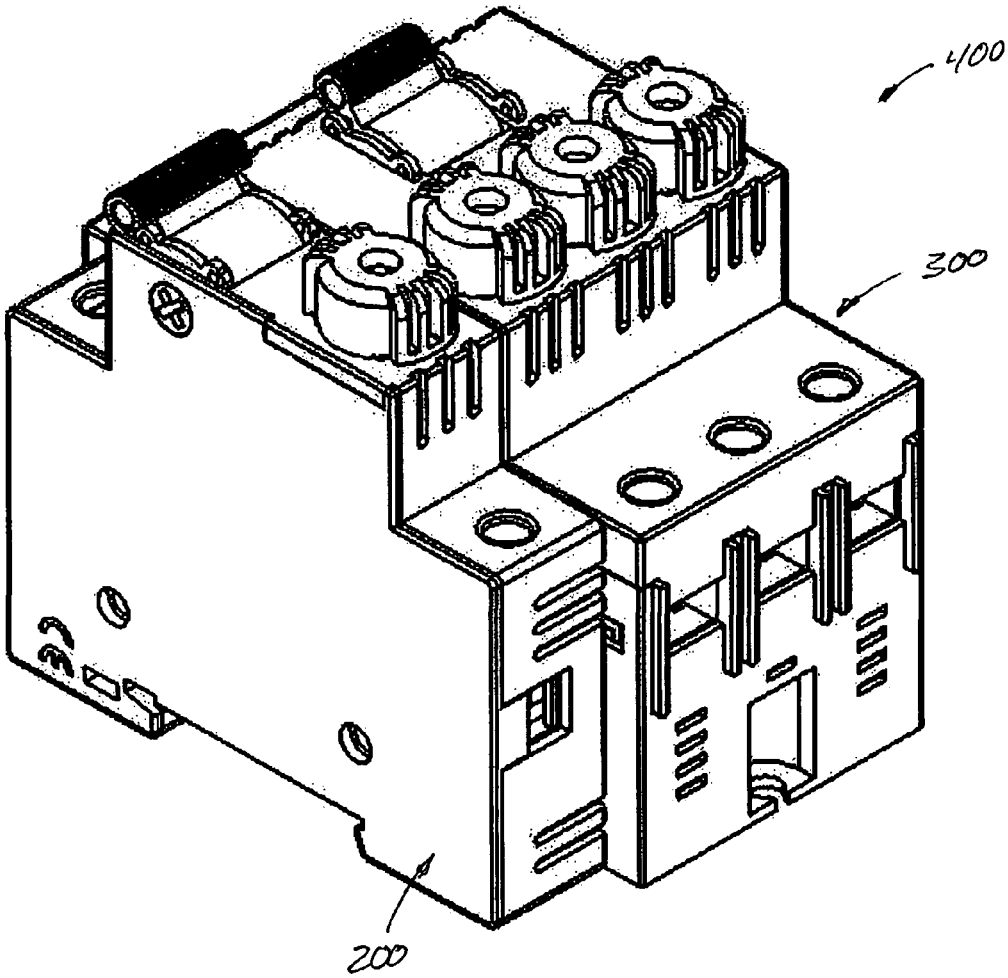
FIG. 11 is a perspective view of a seventh embodiment of a fusible switching disconnect device.

FIG. 11 is a perspective view of a seventh exemplary embodiment of a fusible switching disconnect device 400 which is essentially the disconnect device 300 and a disconnect device 220 coupled together. The disconnect device 300 provides three poles for an AC power circuit and the device 220 provides an additional pole for other purposes.

Embodiments of fusible disconnect devices are therefore described herein that may be conveniently switched on and off in a convenient and safe manner without interfering with workspace around the device. The disconnect devices may reliably switch a circuit on and off in a cost effective manner and may be used with standardized equipment in, for example, industrial control applications. Further, the disconnect device may be provided with various mounting and connection options for versatility in the field.

One embodiment of a fusible switch disconnect module is disclosed herein. The module includes a disconnect housing adapted to receive at least one fuse therein; line side and load side terminals communicating with the at least one fuse when the fuse is inserted into the housing; and switchable contacts provided between one of the line side terminal and load side terminal of the disconnect housing and the fuse. The fuse is removably insertable in the housing; and the switchable contacts include at least one stationary contact and at least one movable contact being selectively positionable along a linear axis with respect to the stationary contact between an open position and a closed position to connect or disconnect an electrical connection through the fuse.

Optionally, the stationary contact includes a pair of stationary contacts, and one of the stationary contacts provided on the line side terminal. At least one fuse terminal may be provided and adapted to engage a conductive element of the fuse, wherein the at least one stationary contact includes a pair of stationary contacts, one of the stationary contacts provided on the fuse terminal. A movable bar may be provided with at least one movable contact, and a rotatably mounted switch actuator may be provided to position the movable contact between the open and closed positions, and a bias element may assist moving movable contact to the opened or closed position. At least two movable contacts may be provided and spaced from one another, thereby breaking electrical arcing in two locations spaced from one another when the switchable contacts are opened. An arc chute compartment may be provided in the disconnect housing to contain and dissipate arc energy at a location in the disconnect housing remote from a user. The switchable contacts may be lockable in one of the opened or closed positions, and the switch actuator may include a retention bar to prevent removal of the fuse from the disconnect housing unless the switchable contacts are in the open position. The disconnect housing may be adapted to receive a cartridge fuse or a rectangular fuse module, and modular housings may be provided and ganged to one another, each of the modular housings including switchable contacts to connect or disconnect a respective fuse. The switch actuator may simultaneously connect or disconnect multiple fuses. A fuse cover may extend over the exposed portion of the fuse, the fuse cover being lockable to prevent removal of the fuse from the disconnect housing. An electromagnetic coil may be provided and may be adapted to open the switchable contacts in one of an undervoltage or an overvoltage condition.

An embodiment of a single pole fusible switch disconnect device is also described herein. The device includes a disconnect housing adapted to receive a fuse therein, the fuse being separately provided from the housing and being removably insertable in the housing; line side and load side terminals connecting to the fuse when the fuse is inserted into the housing, at least one of the line and load-side terminals including a first stationary switch contact provided between the respective line side terminal and load side terminal and the fuse; a terminal adapted to engage a conductive element of the fuse when inserted into the disconnect housing, the fuse terminal including a second stationary switch contact provided on the at least one fuse terminal; a sliding bar within the disconnect housing, the sliding bar provided with first and second movable contacts corresponding to the first and second stationary switch contacts; and a rotatably mounted switch actuator to position the sliding bar and first and second movable contacts between an open position and a closed position relative to the first and second stationary switch contacts to connect or disconnect an electrical connection through the fuse.

An embodiment of a multiple pole fusible switch disconnect device is also described herein. The device includes a disconnect housing adapted to receive a plurality of fuses therein, the fuses being separately provided from the housing and being removably insertable in the housing; line side and load side terminals connecting to the respective fuses when the fuses are inserted into the disconnect housing, and stationary switch contacts provided between one of the respective line side terminal and load side terminal for each of the fuses; fuse terminals adapted to receive and engage a conductive element of each respective fuse when inserted into the disconnect housing, each fuse terminal including a second stationary switch contact; sliding actuator bars corresponding to each respective fuse, the sliding bars provided with first and second movable contacts completing electrical connections through each of the fuses when moved to a closed position; and a rotatably mounted switch actuator to position the sliding bars to connect or disconnect an electrical connection through the fuses, the switch actuator simultaneously connecting or disconnecting the fuses. Optionally, the disconnect housing may be adapted to be ganged together with a second disconnect housing.

Still another embodiment of a fusible switch disconnect device is described herein. The device includes means for housing at least one fuse, the fuse being removably insertable into the housing; means for connecting the fuse to a circuit; means for switching the means for connecting to connect or disconnect an electrical connection through the fuse, the means for switching located within the means for housing; and means for actuating the means for switching and selectively positioning the means for switching in opened and closed positions without removing fuse from the means for housing. Optionally, the device may further include means for opening the means for switching to one of a connected or disconnected position in response to one of an overvoltage event and an undervoltage event.

While the invention has been described in terms of various specific embodiments, those skilled in the art will recognize that the invention can be practiced with modification within the spirit and scope of the claims.

What is claimed is:

1. A fusible switch disconnect module comprising:

a disconnect housing adapted to directly receive at least one fuse therein without use of a fuse carrier, the fuse being removably insertable in the housing;

line side and load side terminals communicating with the at least one fuse when the fuse is inserted into the housing; and switchable contacts provided between one of the line side terminal and load side terminal of the disconnect housing and the fuse, the switchable contacts comprising at least one stationary contact and at least one movable contact being selectively positionable along a linear axis with respect to the stationary contact between an open position and a closed position to connect or disconnect an electrical connection through the fuse; and a bias element assisting movement of the movable contact to the open position.

2. A fusible switch disconnect in accordance with claim 1, wherein the at least one stationary contact comprises a pair of stationary contacts, one of the stationary contacts provided on the line side terminal.

3. A fusible switch disconnect module in accordance with claim 1, further comprising at least one fuse terminal adapted to engage a conductive element of the at least one fuse, wherein the at least one stationary contact comprises a pair of stationary contacts, one of the stationary contacts provided on the at least one fuse terminal.

4. A fusible switch disconnect module in accordance with claim 1, further comprising a movable bar within the disconnect housing, the movable bar provided with the at least one movable contact.

5. A fusible switch disconnect module in accordance with claim 1, further comprising a rotatably mounted switch actuator to position the movable contact between the open and closed positions.

6. A fusible switch disconnect module in accordance with claim 1, wherein the switchable contacts comprise at least two stationary contacts spaced from one another and at least two movable contacts spaced from one another, thereby breaking electrical arcing in two locations spaced from one another when the switchable contacts are opened.

7. A fusible switch disconnect module in accordance with claim 1, wherein an arc chute compartment is provided in the disconnect housing to contain and dissipate arc energy at a location in the disconnect housing remote from a user.

8. A fusible switch disconnect module in accordance with claim 1, wherein the switchable contacts are lockable in one of the opened or closed positions.

9. A fusible switch disconnect module in accordance with claim 1, further comprising a switch actuator, the switch actuator comprising a retention bar to prevent removal of the fuse from the disconnect housing unless the switchable contacts are in the open position.

10. A fusible switch disconnect module in accordance with claim 1, wherein the disconnect housing is adapted to receive a cartridge fuse.

11. A fusible switch disconnect module in accordance with claim 1, wherein the disconnect housing comprises multiple modular housings ganged to one another, each of the modular housings comprising switchable contacts to connect or disconnect a respective fuse.

12. A fusible switch disconnect module in accordance with claim 1, wherein the fuse is partially exposed through an upper surface of the disconnect housing after the fuse is inserted therein.

13. A fusible switch disconnect module in accordance with claim 12, further comprising a fuse cover extending over the exposed portion of the fuse, the fuse cover being lockable to prevent removal of the fuse from the disconnect housing.

14. A fusible switch disconnect device comprising:

means for housing at least one fuse, the fuse being removably insertable into the means for housing without utilizing a fuse carrier;

means for connecting the fuse to a circuit;

means for switching the means for connecting to connect or disconnect an electrical connection through the fuse, the means for switching located within the means for housing; and means for actuating the means for switching and selectively positioning the means for switching in opened and closed positions without removing the fuse from the means for housing; and means for biasing the means for switching to the disconnected position.

15. The fusible switch disconnect device of claim 14, wherein the switchable means comprises a plurality of movable contacts to dissipate are energy at more than one location.

16. The fusible switch disconnect device of claim 14, wherein the means for housing is adapted to receive at least one of a cartridge fuse and a rectangular fuse module.

17. The fusible switch disconnect device of claim 14, wherein the means for housing comprises means for containing and dissipating arc energy at a Location remote from a user.

18. The fusible switch disconnect device of claim 14, wherein the means for actuating comprises rotating means and sliding means.

19. The fusible switch disconnect device of claim 14, further comprising means for locking the fuse to the means for housing.

20. The fusible switch disconnect device of claim 14, wherein the means for biasing comprises one of a tension spring and a compression spring.

21. A single pole fusible switch disconnect device comprising:

a disconnect housing adapted to directly receive a fuse therein, the fuse being separately provided from the housing and being removably insertable in the housing without the use of a fuse carrier;

line side and load side terminals connecting to the fuse when the fuse is inserted into the housing, at least one of the line and load-side terminals comprising a first stationary switch contact provided between the respective line side terminal and load side terminal and the fuse;

a fuse terminal adapted to engage a conductive element of the fuse when inserted into the disconnect housing, the fuse terminal comprising a second stationary switch contact;

a sliding bar within the disconnect housing, the sliding bar provided with first and second movable contacts corresponding to the first and second stationary switch contacts;

a rotatably mounted switch actuator to position the sliding bar and first and second movable contacts between an open position and a closed position relative to the first and second stationary switch contacts to connect or disconnect an electrical connection through the fuse;

wherein when the switch actuator is rotated to position the sliding bar and the first and second movable contacts to the open position, the sliding bar pulls the first and second movable contacts away from the first and second stationary switch contacts.

22. A fusible switch disconnect device in accordance with claim 21, wherein an arc chute compartment is provided in the disconnect housing to contain and dissipate arc energy at a location in the disconnect housing remote from a user.

23. A fusible switch disconnect device in accordance with claim 21, wherein the first and second movable contacts are lockable in one of the opened or closed positions.

24. A fusible switch disconnect device in accordance with claim 21, wherein the disconnect housing is adapted to receive one of a cartridge fuse and a rectangular fuse module.

25. A fusible switch disconnect device in accordance with claim 21, further comprising a bias element assisting move ment of the switchable contacts to the opened or closed position.

26. A fusible switch disconnect device in accordance with claim 21, wherein the disconnect housing is adapted to be ganged together with a second disconnect housing.

27. A fusible switch disconnect module in accordance with claim 21, further comprising an electromagnetic coil adapted to open the switchable contacts in one of an undervoltage or an overvoltage condition.

* * * * *